US007492383B2

(12) United States Patent
Hirai

(10) Patent No.: US 7,492,383 B2
(45) Date of Patent: Feb. 17, 2009

(54) THERMAL PRINTER

(75) Inventor: Kimitaka Hirai, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 11/893,885

(22) Filed: Aug. 17, 2007

(65) Prior Publication Data

US 2008/0068437 A1 Mar. 20, 2008

(30) Foreign Application Priority Data

Sep. 15, 2006 (JP) ..... 2006-250419

(51) Int. Cl.
*B41J 11/00* (2006.01)
*B41J 11/02* (2006.01)

(52) U.S. Cl. ..... 347/220

(58) Field of Classification Search ..... 347/220, 347/222; 400/649, 651, 653
See application file for complete search history.

(56) References Cited

U.S. PATENT DOCUMENTS 6,078,345 A * 6/2000 Yamakawa et al. ..... 347/218
6,249,302 B1 * 6/2001 Sekiya ..... 347/220
2003/0058327 A1 * 3/2003 Louis ..... 347/220
2005/0232679 A1 * 10/2005 Na et al. ..... 400/649
2006/0001730 A1 * 1/2006 Sawai ..... 347/220

FOREIGN PATENT DOCUMENTS

JP 2003200624 7/2003

* cited by examiner

*Primary Examiner*—K. Feggins
(74) *Attorney, Agent, or Firm*—Adams & Wilks

(57) ABSTRACT

There is provided a thermal printer (1) including: a main body frame (2); a thermal head (4) mounted to the main body frame (2); a platen roller (6) disposed to be opposed to a printing surface (4*a*) of the thermal head (4), for sandwiching a thermal paper (15) with the thermal head (4) to feed the thermal paper (15); a lock arm (5) swingably mounted to the main body frame (2), for locking the platen roller (6) with the main body frame (2) by pressing a shaft bearing (11) which rotatably supports the platen roller (6) against the thermal head (4); a swing arm (10) that supports the shaft bearing (11) of the platen roller (6), and swings between a lock position by the lock arm (5) and a release position apart from the lock arm (5); and a lever (16) movably provided to the swing arm (10), for releasing a locked state of the platen roller (6) by the lock arm (5) by an external force applied to a force point (18), in which a direction in which the force point (18) of the lever (16) moves when the locked state by the lock arm (5) is released is same as a swinging direction of the swing arm (10).

8 Claims, 5 Drawing Sheets

THERMAL PRINTER

BACKGROUND OF THE INVENTION

1. Field of the Invention

The present invention relates to a thermal printer.

2. Description of the Related Art

As a conventional thermal printer, there is one disclosed in Patent Document 1.

The thermal printer disclosed in Patent Document 1 includes a cover member for supporting a platen roller disposed to be opposed to a printing surface of a thermal head. The cover member is locked by a lock arm in a state where the platen roller is close contact with the printing surface of the thermal head, so the cover member is locked with respect to a case main body.

Further, by operating a release lever provided to the case main body, the lock arm is swung by the release lever to release a locked state of the platen roller with the result that the locked state of the cover member with respect to the case main body is released. The cover member whose locked state is released can swing with respect to the case member, so it is possible to open a receiving portion for receiving a roll-formed thermal paper of the case main body.

However, in the thermal printer disclosed in Patent Document 1, it is necessary to operate the release lever provided to the case main body in order to open the cover member, and the operation includes two steps, which is inconvenient. That is, in a case where the operation is performed with both hands, first the release lever is operated with the left hand (or right hand) to release the locked state by the lock arm, and then the cover member is swung with the right hand (or left hand) to open the receiving portion. Alternatively, in a case where the operation is performed with one hand, it is also necessary to perform the operation including noncontinuous two steps including first operating the release lever of the case main body and then swinging the cover member.

[Patent Document 1] JP 2003-200624 A

SUMMARY OF THE INVENTION

The present invention has been made in view of the circumstances described above, and it is an object of the present invention to provide a thermal printer in which an operator can release a locked state of a platen roller by a lock arm, cause the platen roller to be spaced apart from the thermal head, and quickly perform an exchange operation and the like of a thermal paper with one step of operation.

In order to attain the above-mentioned object, the present invention provides the following means.

The present invention provides a thermal printer including: a main body frame; a thermal head mounted to the main body frame; a platen roller disposed to be opposed to a printing surface of the thermal head, for sandwiching a thermal paper with the thermal head to feed the thermal paper; a lock arm swingably mounted to the main body frame, for locking the platen roller with the main body frame by pressing a shaft bearing which rotatably supports the platen roller against the thermal head; a swing arm that supports the shaft bearing of the platen roller, and swings between a lock position by the lock arm and a release position apart from the lock arm; and a lever movably provided to the swing arm, for releasing a locked state of the platen roller by the lock arm by an external force applied to a force point, in which a direction in which the force point of the lever moves when the locked state by the lock arm is released is same as a swinging direction of the swing arm.

According to the present invention, by moving the lever by applying the external force to the force point of the lever provided to the swing arm, the locked state of the platen roller by the lock arm can be released. In this case, the moving direction of the force point of the lever when the locked state by the lock arm is released is set to be the same as the swinging direction of the swing arm. Therefore, an operator can readily and quickly perform a releasing operation of the locked state by the lock arm by operating the lever and an swing operation of the swing arm for moving the platen roller away from the printing surface of the thermal head as one step of continuous operation.

In the present invention, the lever may be provided so that the lever can move substantially about an axial center of the platen roller.

As a result, it is possible for the lever moving about the axial center of the platen roller to press the lock arm to release the lock without protruding the lock arm for locking the platen roller from the platen roller by a large amount.

In the present invention, the force point of the lever may include a pressure receiving surface which extends in a direction orthogonal to the swinging direction of the swing arm in terms of the force point.

As a result, when the external force is applied to the pressure receiving surface provided to the force point of the lever, the external pressure is readily applied to the swing direction of the swing arm, so one step of the continuous operation can be performed further readily.

In the present invention, the swing arm preferably constitutes a cover of a receiving portion for receiving a roll-formed thermal paper.

As a result, the swing arm is swung with the result that the platen roller is spaced apart from a printing surface of the thermal head, and at the same time the receiving portion of the roll-formed thermal paper can be opened. Thus, a recovering operation of a paper jam or an exchange operation of a thermal paper can be performed quickly.

According to the present invention, there is an effect that an operator can release a locked state of a platen roller by a lock arm and cause the platen roller to be spaced apart from a thermal head with one step of operation.

DETAILED DESCRIPTION OF THE PREFERRED EMBODIMENT

Referring to FIGS. 1 to 5, a thermal printer 1 according to an embodiment of the present invention will be described below.

Figure 1:
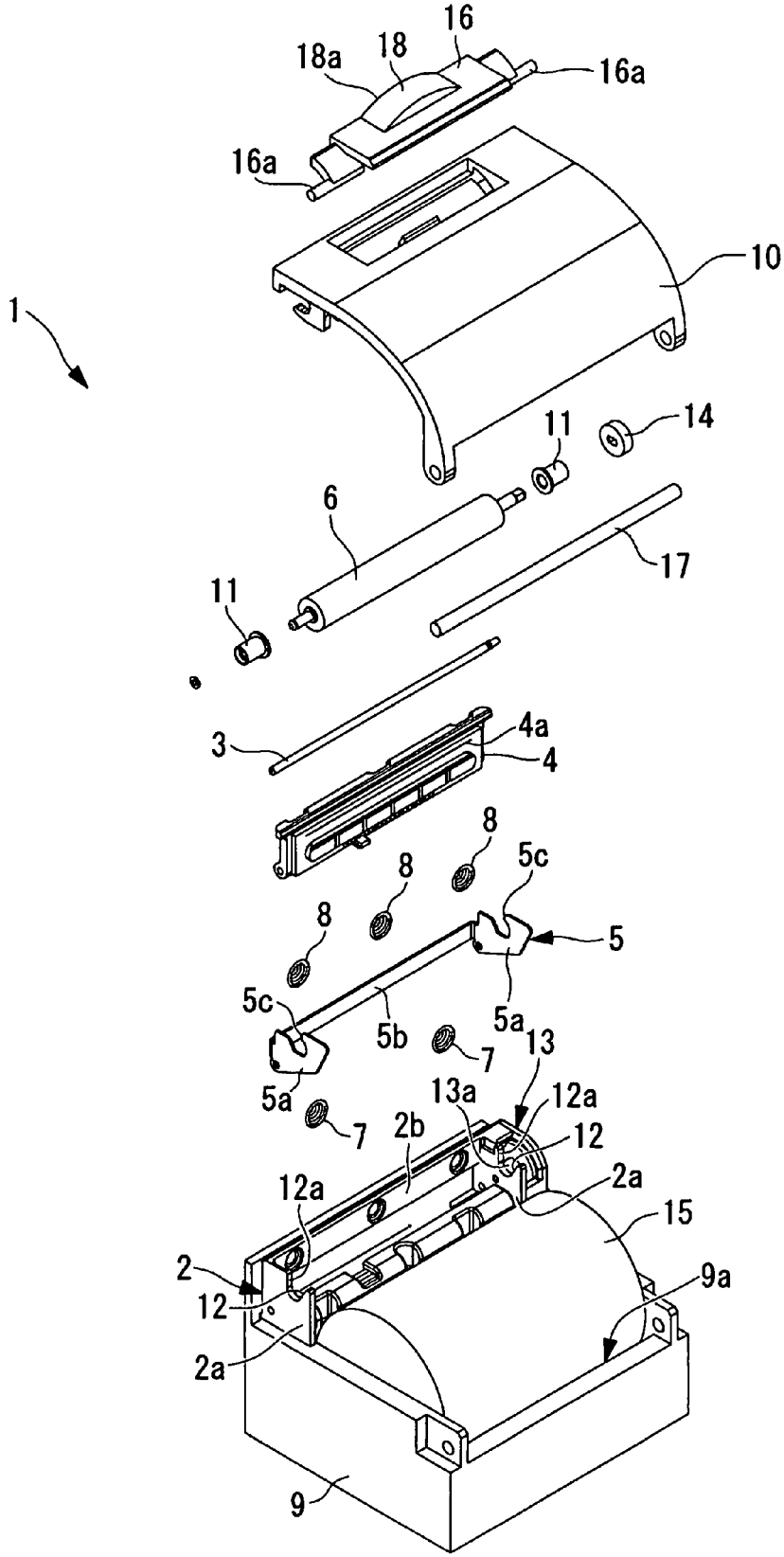
FIG. 1 is an exploded perspective view showing a thermal printer according to an embodiment of the present invention.

As shown in FIG. 1, the thermal printer 1 of the embodiment includes: a main body frame 2; a thermal head 4 and a lock arm 5 swingably mounted to a coaxial shaft 3 of the main body frame 2; a platen roller 6 supported by the lock arm 5; first springs 7, for biasing the platen roller 6 to the thermal head 4 side; and second springs 8 for biasing the thermal head 4 to the platen roller 6 direction. The thermal printer 1 further includes a case main body 9 to which the main body frame 2 is fixed and a cover member 10 provided to the case main body 9.

The main body frame 2 is provided with side walls 2*a* for bridging the shaft 3 and a back surface coupling plate portion 2*b* for coupling the side walls 2*a*. The side walls 2*a* of the main body frame 2 are provided with notches 12, respectively, for receiving a shaft bearing 11 (described later) of the platen roller 6. The notches 12 are provided with stopblock edges 12*a* provided in parallel so as to be spaced apart by a predetermined distance from the back surface coupling plate portion 2*b*. Further, each notch 12 is formed such that an opening width thereof becomes large in its opening direction, and has a structure for readily receiving each shaft bearing 11 of the platen roller 6. Further, the main body frame 2 is provided with a motor (not shown) and a rotation transmitting mechanism 13 for transmitting a rotational force of the motor to the platen roller 6.

Figure 2:
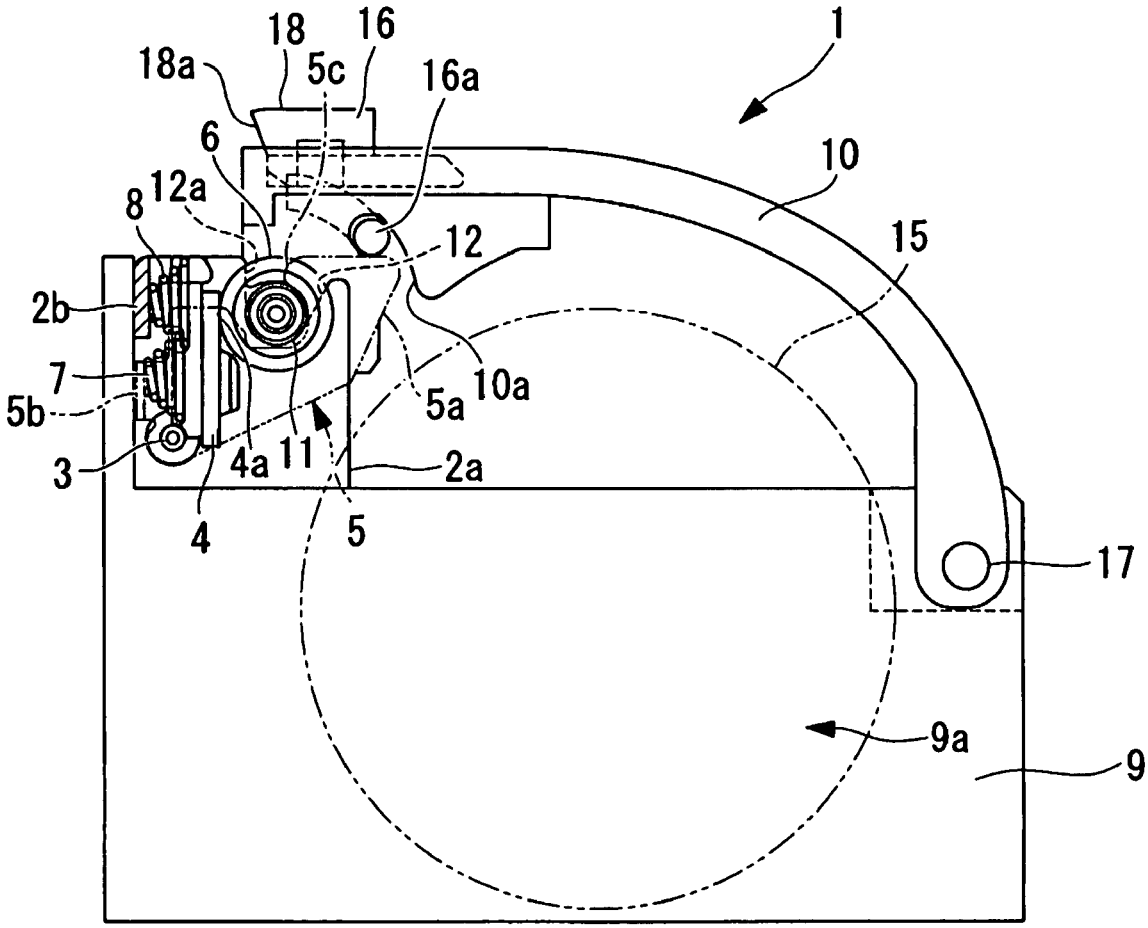
FIG. 2 is a longitudinal sectional view showing a state where a platen roller is locked by a lock arm in the thermal printer of FIG. 1.

As shown in FIG. 2, the thermal head 4 is mounted to the shaft 3 mounted to the main body frame 2 so as to be capable of swinging about the shaft 3 in a state where a side surface, which is a back surface of a printing surface 4*a* provided on one surface side, is opposed to the back surface coupling plate portion 2*b* of the main body frame 2. The printing surface 4*a* of the thermal head 4 is disposed at a position where the printing surface 4*a* approximately corresponds to the back surface coupling plate portion 2*b* in a thickness direction of the thermal head 4.

Further, the second springs 8 are sandwiched between the back surface of the thermal head 4 and the back surface coupling plate portion 2*b* of the main body frame 2. Each second spring 8 is a compressed coil spring being a conical coil spring. Accordingly, the thermal head 4 is constantly biased in the printing surface 4*a* side due to a biasing force of the second springs 8.

The shaft bearings 11 for rotatably supporting the platen roller 6 are provided on both-ends of the platen roller 6, respectively. Further, a gear 14, which engages with a gear 13*a* of the rotation transmitting mechanism 13 when the shaft bearings 11 are supported by the notches 12, is fixed to an end of the platen roller 6.

The lock arm 5 is mounted to the main body frame 2 by the shaft 3 so as to be capable of swinging thereabout, and includes two side plate portions 5*a* extending along the both side walls 2*a* of the main body frame 2 and a back plate portion 5*b* for coupling the side plate portions 5*a*.

The lock arm 5 is provided with claw portions 5*c* at its end portions, which extend to the printing surface 4*a* side of the thermal, head 4 in the state where the lock arm 5 is mounted to the main body frame 2, and prevent the platen roller 6 from being detached by enclosing the shaft bearings 11 of the platen roller 6 supported by the notches 12 of the main body frame 2 to decrease the opening width of the notches 12. Further, in this state, the back plate portion 5*b* of the lock arm 5 is disposed to the back surface side of the thermal head 4.

In addition, the first springs 7 are sandwiched between the back plate portion 5*b* of the lock arm 5 and the back surface of the thermal head 4. Each first spring 7 is a compressed coil spring being a conical coil spring.

Accordingly, the lock arm 5 is constantly biased by the first springs 7 in a direction in which the shaft bearings 11 of the platen roller 6 are pressed against the stopblock edges 12*a* of the notches 12 of the main body frame 2. Further, in the state where the shaft bearings 11 of the platen roller 6 are pressed against the stopblock edges 12*a* of the notches 12, the claw portions 5*c* lower the opening widths of the notches 12 and the shaft bearings 11 are supported so as not to be detached from the notches 12, so the platen roller 6 is locked in a positioning state with respect to the main body frame 2.

The case main body 9 is provided with a receiving portion 9*a* for receiving a roll-formed thermal paper 15.

Further, the cover member 10 is swung with respect to the case main body 9 so as to be operated between a release position (unlock position) for releasing the receiving portion 9*a* and a close position (lock position) for closing the receiving portion 9*a*. In the figures, reference numeral 17 indicates a shaft for fixing the cover member 10 to the case main body 9 so as to be capable of swinging.

In the vicinity of swing end of the cover member 10, the shaft bearings 11 of the platen roller 6 is supported. Accordingly, when the cover member 10 is swung, the platen roller 6 supported in the vicinity of swing end of the cover member 10 is also swung together with the cover member 10, and the platen roller 6 is locked by the lock arm 5 at the close position of the cover member 10.

Further, in the vicinity of the swing end of the cover member 10, a lever 16 is supported so as to be capable of moving about an axial center of the platen roller 6.

The lever 16, for example, includes at both ends thereof projections 16*a* extending in parallel with the axial center of the platen roller 6 and disposed in circular-arc shaped grooves 10*a* provided to the cover member 10. The projections 16*a* are swung along the circular-arc shaped grooves 10*a*, so the lever 16 can be moved about the axial center of the platen roller 6 with respect to the cover member 10.

Figure 3:
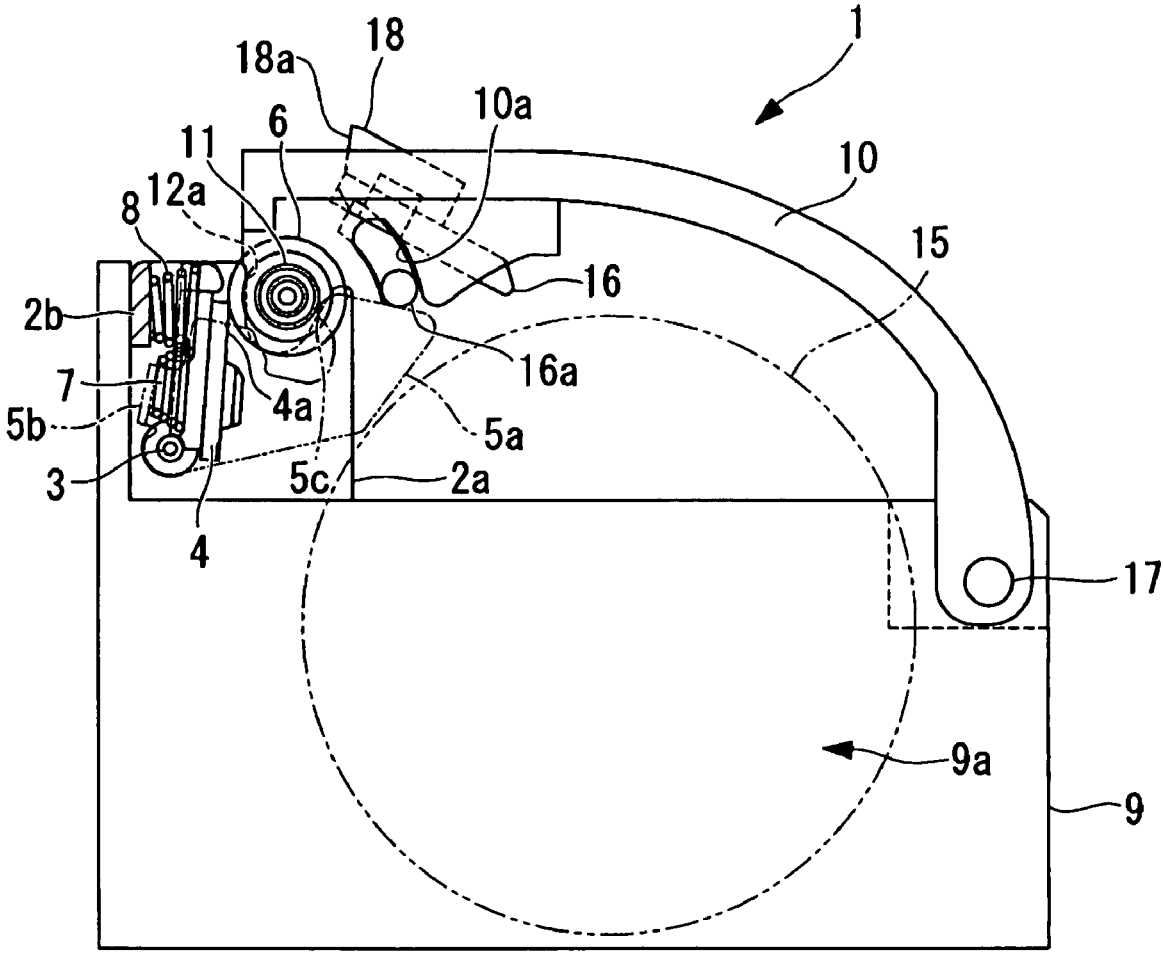
FIG. 3 is a longitudinal sectional view showing a state where a platen roller is unlocked by a lock arm in the thermal printer of FIG. 1.

Further, in the state where the shaft bearings 11 of the platen roller 6 are locked by the lock arm 5, the projections 16*a* of the lever 16 are disposed so as to touch an upper end of the lock arm 5. Accordingly, as shown in FIG. 3, when the lever 16 is moved with respect to the cover member 10, the projections 16*a* of the lever 16 presses the upper end of the lock arm 5, and the lock arm 5 is swung about the shaft 3. As a result, the claw portions 5*c* of the lock arm 5 releases the shaft bearings 11 to release the locked state.

Figure 5:
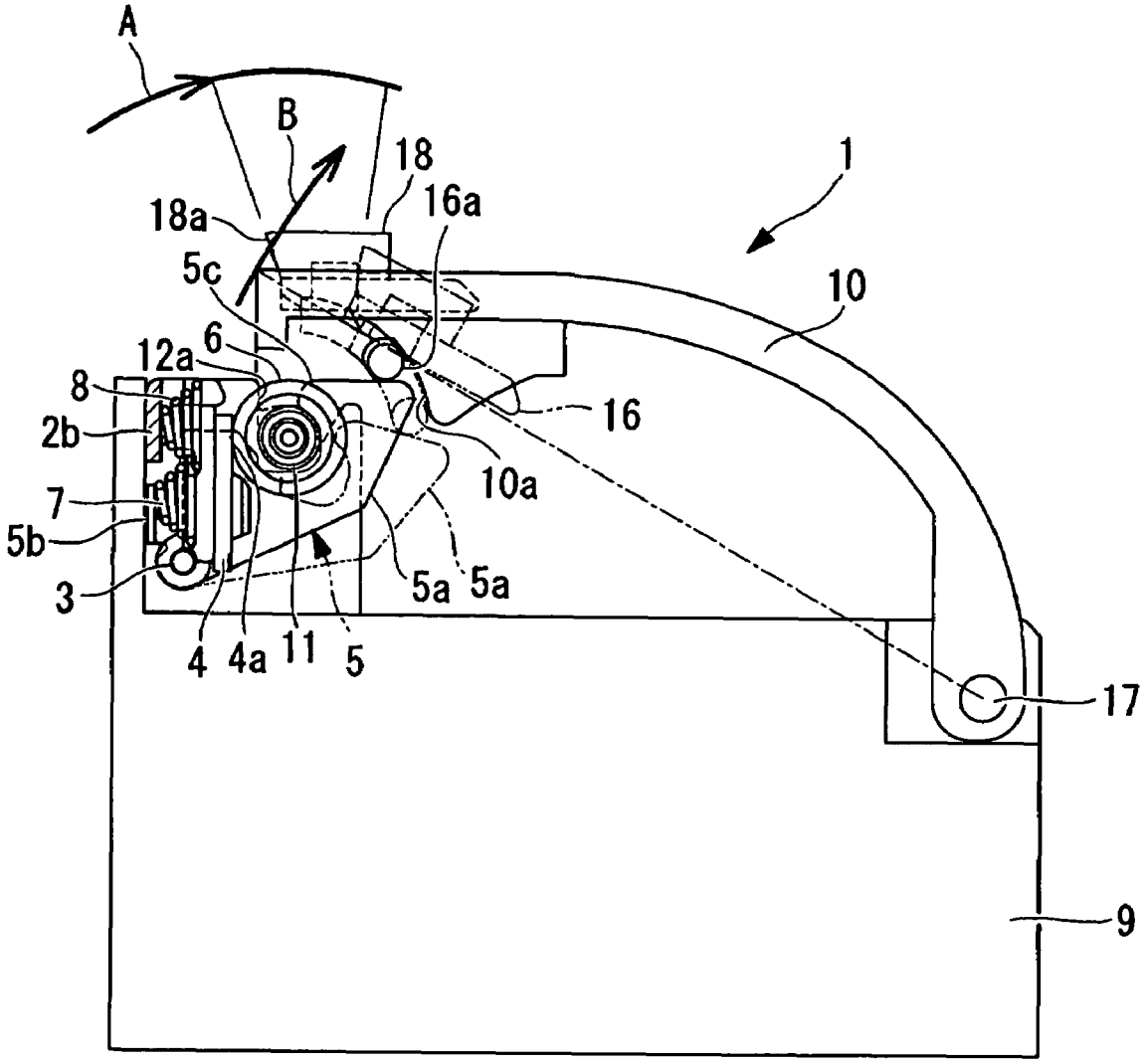
FIG. 5 is a longitudinal sectional view explaining a swinging direction of a cover member and a moving direction of a lever in the thermal printer of FIG. 1.

Herein, in the thermal printer 1 according to the embodiment, as shown in FIG. 5, a moving direction A of the lever 16 in releasing the locked state by the lock arm 5 is same as a swinging direction B of the cover member 10.

In this case, the situation where the moving direction A and the swinging direction B are the same means a state where the moving direction A and the swinging direction B direct a same rotational side with respect to an swing center (shaft 17) of the cover member 10, and does not necessarily mean that the moving direction A and the swinging direction B completely coincide with each other.

Further, the lever 16 includes an operation portion 18 (force point) with which an operator operates in releasing the locked state by the lock arm 5. As shown in FIG. 5, the operation portion 18 includes a pressure receiving surface 18*a* extending in a direction orthogonal to the swinging direction B of the cover member 10. Accordingly, an external force imposed in a direction orthogonal to the pressure receiving surface 18*a* can be used as an external force for swinging the cover member 10.

An operation of the thermal printer 1 of the embodiment structured as described above will be described below.

Figure 4:
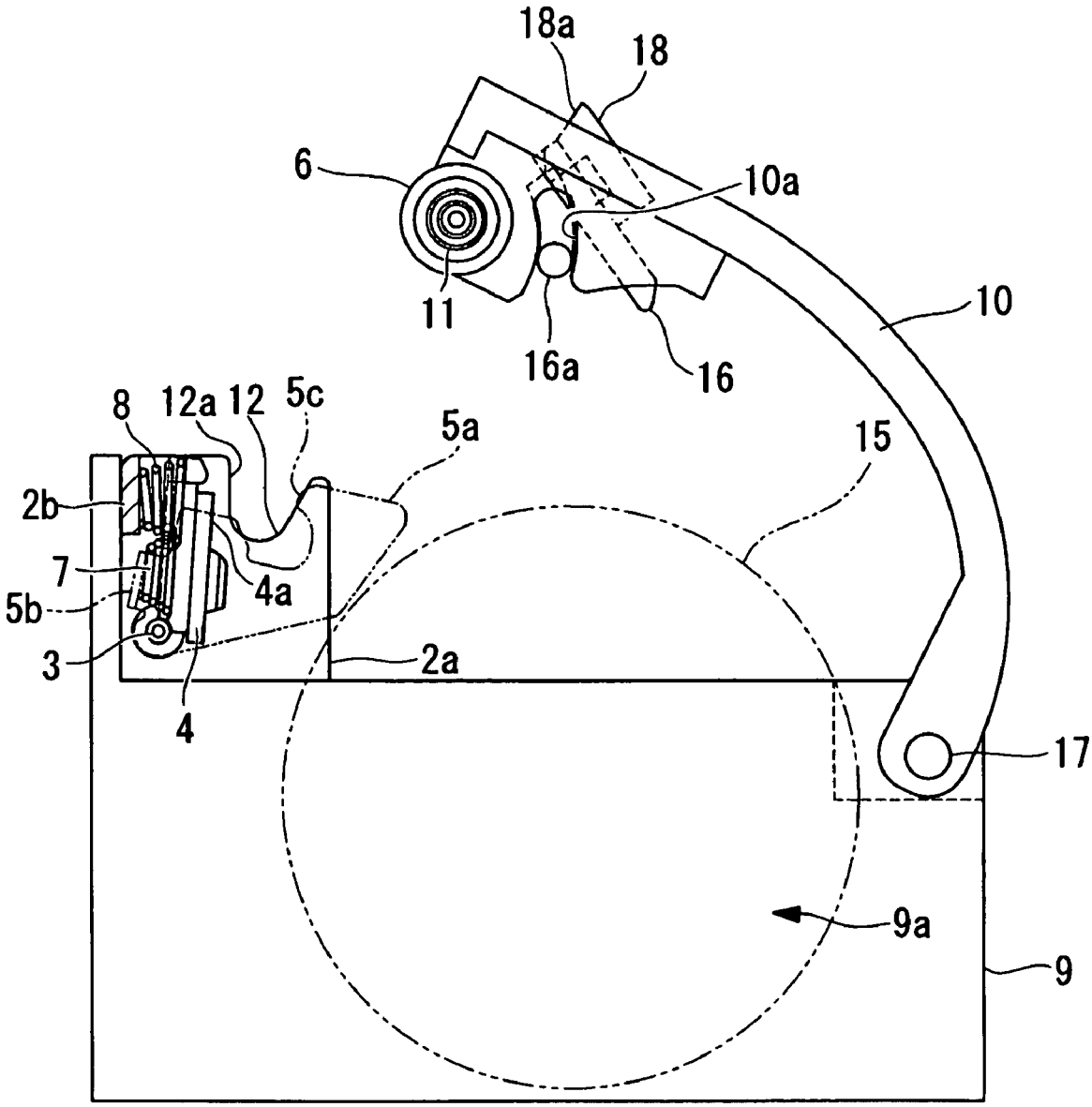
FIG. 4 is a longitudinal sectional view showing a state where a platen roller is spaced apart from a thermal head in the thermal printer of FIG. 1.

According to the thermal printer 1 of the embodiment, in a case where setting the thermal paper 15 between the thermal head 4 and the platen roller 6, the operator operates the lever 16 provided to the cover member 10 to open the cover member 10 as shown in FIG. 4 and receives the roll-formed thermal paper 15 in the receiving portion 9*a* provided to the case main body 9.

In this case, when an external force is applied to the operation portion 18 provided to the lever 16, the lever 16 moves about the axial center of the platen roller 6 with respect to the cover member 10, and the projections 16*a* provided to the lever 16 push the lock arm 5 which locks the shaft bearings 11 of the platen roller 6. The lock arm 5 is pushed by the projections 16*a* of the lever 16 to swing about the shaft 3. The claw portions 5*c* provided at its swing end are moved to increase the opening width of the notches 12 of the main body frame 2.

As a result, the locked state of the shaft bearings 11 of the platen roller 6 by the lock arm 5 is released, and the platen roller 6 is capable of moving in a direction in which the platen roller 6 is spaced apart from the thermal head 4. Then, by swinging the cover member 10, the platen roller 6 mounted to the swing end of the cover member 10 is allowed to move in a direction in which the platen roller 6 is spaced apart from the thermal head 4, and the receiving portion 9*a* provided to the case main body 9 is exposed.

In this case, according to the embodiment, since the moving direction A of the lever 16 with respect to the cover member 10 is the same as the swinging direction B of the cover member 10, an external force imposed by the operator to the operation portion 18 of the lever 16 can be used for both the movement of the lever 16 and the swing of the cover member 10.

In the example shown in FIG. 5, by applying an external force to the operation portion 18 of the lever 16 to move the lever 16 clockwise, the locked state by the lock arm 5 is released and the cover member 10 is swung clockwise to be opened.

As a result, the operator can release the locked state of the platen roller 6 by the lock arm 5 and make the platen roller 6 spaced apart from the thermal head 4 by performing one step of operation, that is, moving the operation portion 18 of the lever 16 in one direction with one hand.

Accordingly, the operator can open the cover member 10 readily and set the roll-formed thermal paper 15 in the receiving portion 9*a* without using the both hands. That is, in a case of a recovering operation of a paper jam or a supplying operation of the thermal paper 15, the operation can be performed extremely readily and quickly, which is advantageous.

Further, in the embodiment, the pressure receiving surface 18*a* extending in the direction orthogonal to the swinging direction B of the cover member 10 is provided to the operation portion 18 of the lever 16. Thus, the external force applied by the operator who operates the lever 16 to the direction orthogonal to the pressure receiving surface 18*a* is directly and readily used for the swing operation of the cover member 10, which is advantageous.

Further, in a state where the roll-formed thermal paper 15 is received in the receiving portion 9*a* and a portion of the roll-formed thermal paper 15 is disposed along the printing surface 4*a* of the thermal head 4, the cover member 10 is swung in a reverse direction to close the receiving portion 9*a* by the cover member 10. Then, the cover member 10 is further swung to dispose the shaft bearings 11 of the platen roller 6 provided to the swing end of the cover member 10 in the notches 12 of the main body frame 2 and to return the lock arm 5 to its original state by the first springs 7. Thus, the shaft bearings 11 of the platen roller 6 are locked by the claw portions 5*c* of the lock arm 5. In this case, the shaft bearings 11 of the platen roller 6 are positioned by being pressed against the stopblock edges 12*a* of the notches 12 of the main body frame 2, so the thermal paper 15 is sandwiched between the thermal head 4 and the platen roller 6 by a predetermined biasing force of the second springs 8, and printing can be performed due to the operation of the thermal head 4 and the platen roller 6.

In this case, according to the embodiment, by merely swinging the cover member 10 counterclockwise in FIG. 5, the receiving portion 9*a* can be closed and the shaft bearings 11 of the platen roller 6 can be locked by the lock arm 5. Accordingly, the continuous operation can be readily performed as one step of operation.

Further, in returning the lock arm 5 to its original state, the projections 16*a* which contact with the lock arm 5 are pressed, so the lever 16 provided with the projections 16*a* is moved about the axial center of the platen roller 6 to return to the position as shown in FIG. 2.

That is, according to the embodiment, without providing biasing means such as a spring between the lever 16 and the cover member 10, when the cover member 10 is closed, the lock arm 5 can return the lever 16 to its original position. Thus, the structures of the cover member 10 and the lever 16 can be simplified to reduce cost.

What is claimed is:

1. A thermal printer, comprising:

a main body frame;

a thermal head mounted to the main body frame;

a platen roller disposed to be opposed to a printing surface of the thermal head, for sandwiching a thermal paper with the thermal head to feed the thermal paper;

a lock arm swingably mounted to the main body frame, for locking the platen roller with the main body frame by pressing a shaft bearing which rotatably supports the platen roller against the thermal head;

a swing arm that supports the shaft bearing of the platen roller, and swings between a lock position by the lock arm and a release position apart from the lock arm; and a lever movably provided to the swing arm, for releasing a locked state of the platen roller by the lock arm by an external force applied to a force point, wherein a direction in which the force point of the lever moves when the locked state by the lock arm is released is same as a swinging direction of the swing arm.

2. A thermal printer according to claim 1, wherein the lever is provided so that the lever can move substantially about an axial center of the platen roller.

3. A thermal printer according to claim 2, wherein the force point of the lever includes a pressure receiving surface which extends in a direction orthogonal to the swinging direction of the swing arm in terms of the force point.

4. A thermal printer according to claim 3, wherein the swing arm constitutes a cover of a receiving portion for receiving a roll-formed thermal paper.

5. A thermal printer according to claim 2, wherein the swing arm constitutes a cover of a receiving portion for receiving a roll-formed thermal paper.

6. A thermal printer according to claim 1, wherein the force point of the lever includes a pressure receiving surface which extends in a direction orthogonal to the swinging direction of the swing arm in terms of the force point.

7. A thermal printer according to claim 6, wherein the swing arm constitutes a cover of a receiving portion for receiving a roll-formed thermal paper.

8. A thermal printer according to claim 1, wherein the swing arm constitutes a cover of a receiving portion for receiving a roll-formed thermal paper.

* * * * *